US005704342A

United States Patent [19]

Gibson et al.

[11] Patent Number: 5,704,342

[45] Date of Patent: Jan. 6, 1998

[54] COMPRESSED GAS GUN WITH PRESSURE CONTROL ARRANGEMENT

[75] Inventors: Gary E. Gibson, Wheeling, Ill.; Thomas G. Kotsiopoulos, 449 Sunset Ridge Rd., Northfield, Ill. 60093

[73] Assignee: Thomas G. Kotsiopoulos, Northfield, Ill.

[21] Appl. No.: 449,888

[22] Filed: May 25, 1995

[51] Int. Cl.[6] ..... F41B 11/00

[52] U.S. Cl. ..... 124/73; 124/76

[58] Field of Search ..... 124/61, 73, 74, 124/75, 76

[56] References Cited

U.S. PATENT DOCUMENTS

| | | | |
|---|---|---|---|
| 2,817,328 | 12/1957 | Gale | 124/76 X |
| 3,572,310 | 3/1971 | Chiba | 124/76 |
| 4,616,622 | 10/1986 | Miliman | 124/73 |
| 4,819,610 | 4/1989 | Lacam et al. | 124/75 |
| 4,936,282 | 6/1990 | Dobbins et al. | 124/73 X |
| 5,224,465 | 7/1993 | Milliman | 124/73 X |
| 5,265,582 | 11/1993 | Bhogal | 124/73 |
| 5,280,778 | 1/1994 | Kotsiopoulos | 124/73 |
| 5,383,442 | 1/1995 | Tippmann | 124/73 X |

*Primary Examiner*—Terry Lee Melius
*Assistant Examiner*—Thomas A. Beach
*Attorney, Agent, or Firm*—Leydig, Voit & Mayer, Ltd.

[57] ABSTRACT

A compressed gas powered gun includes an arrangement that meters the amount of air flow exiting through an outlet port of the gun that tends to restrict the velocity of the exiting air to be less than the speed of sound during normal operation. In addition, the exit velocity of the projectile is less sensitive to pressure variations and may be more closely controlled so that shot to shot consistency of the gun is increased. The firing rate of the gun can also be modified.

6 Claims, 5 Drawing Sheets

COMPRESSED GAS GUN WITH PRESSURE CONTROL ARRANGEMENT

FIELD OF THE INVENTION

The present invention relates to the compressed gas powered gun art, and more particularly, an arrangement used to control the blast of compressed gas and corresponding projectile velocity in a compressed gas powered gun.

BACKGROUND OF THE INVENTION

The present invention is an improvement to the inventions disclosed in U.S. Pat. No. 5,280,778, the subject matter of which is incorporated herein by reference in its entirety. As explained in that patent, compressed gas powered guns are typically used in a recreational sport known as paint ball warfare. When used for this application, the guns fire projectiles or "paint balls" comprising an outer shell filled with a marking material. The marking material comprises a mixture of water and vegetable coloring so that it is not toxic and can be removed from clothing and other surfaces with simple water washing. The outer shell breaks upon impact with a target dispersing the material to mark the target, for example an opposing player, when hit by the paint ball.

There are several desired operating characteristics of these types of guns, particularly when used in tournament settings and the like. For example, maximum projectile velocity limitations are typically imposed. However, adjustment of known arrangements to meet such restrictions has been essentially guesswork. Another desired operating characteristic is consistency of the projectile velocity over the course of time in which the gun is used. For example, projectile velocity in known arrangements has typically been quite sensitive to pressure variation. Further, shot-to-shot consistency is often desirable, especially in tournament settings.

SUMMARY OF THE INVENTION

The present invention provides an improvement over prior art arrangements with a design that meters the amount of gas exiting through an outlet port of the gun. This arrangement tends to restrict the velocity of the exiting gas to be less than the speed of sound during normal operating conditions. In addition, the exit velocity of the projectile is less sensitive to pressure variations and may be more closely controlled so that shot to shot consistency of the gun is increased. Moreover, the firing rate of the gun, in this arrangement, can be easily modified.

The present invention may be embodied in a compressed gas gun including an air chamber, an exit tube coupled with the air chamber, an actuating piston disposed within the exit tube and a breech disposed proximate the exit tube. The exit tube includes a lip section or flange that protrudes inwardly to provide a reduced diameter orifice proximate to an exit point of the air chamber sized to restrict air flow from the air chamber. The size and placement of the reduced diameter orifice controls various operating characteristics of the gun. For example, this arrangement tends to prevent the gas flow exiting from the air chamber and entering into the breech from exceeding the speed of sound during normal operation of the gun. In addition, the velocity of the projectile is less sensitive to pressure variations of the compressed gas contained in the air chamber. In this way, the invention achieves more consistent firings and tends to restrict the maximum velocity of an exiting projectile. Further, depending on the size and shape of the reduced diameter orifice, the firing rate of the gun may be controlled.

DETAILED DESCRIPTION OF THE PREFERRED EMBODIMENT

Generally, the present invention relates to a pressure control arrangement in a compressed gas powered gun. The control arrangement restricts the gas flow rate from an air chamber upon firing of the gun in order to provide restricted maximum projectile velocity and greater firing consistency.

Figure 1:
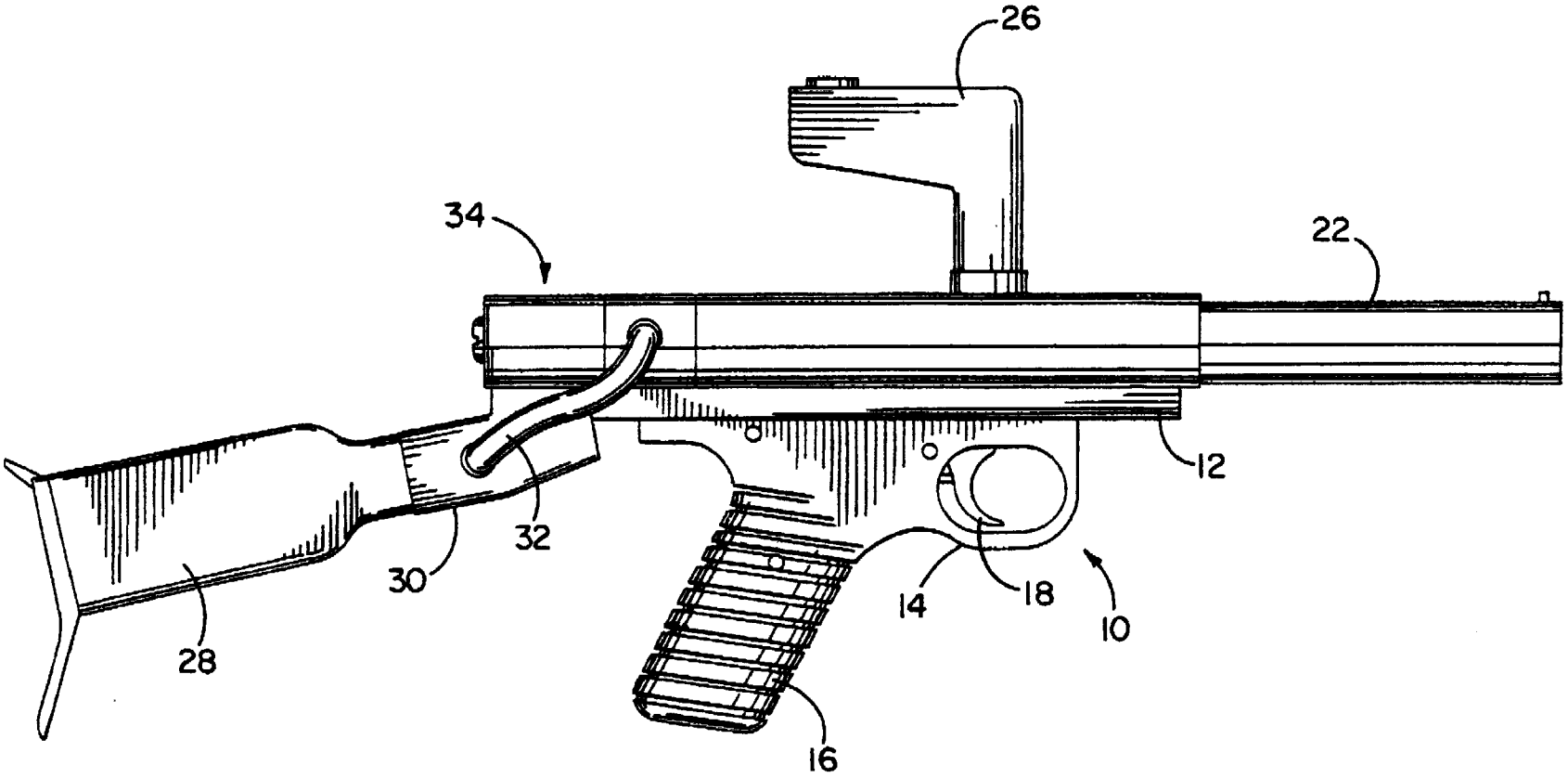
FIG. 1 is a side view of a compressed gas powered gun that utilizes the teachings of the present invention.
Figure 2:
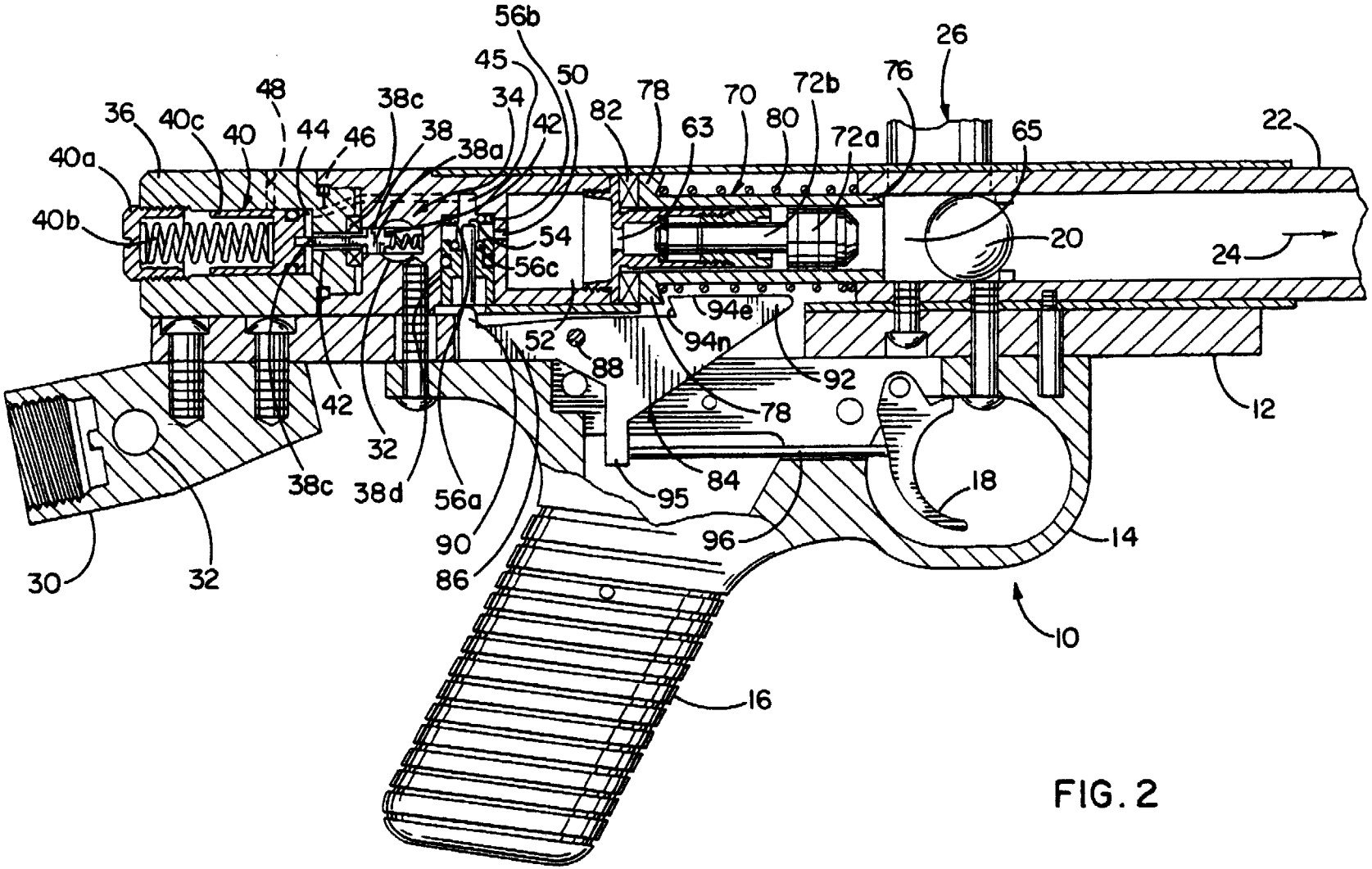
FIG. 2 is sectional view of the compressed gas gun of FIG. 1 in a ready-to-fire position which includes the control arrangement of the present invention.
Figure 3:
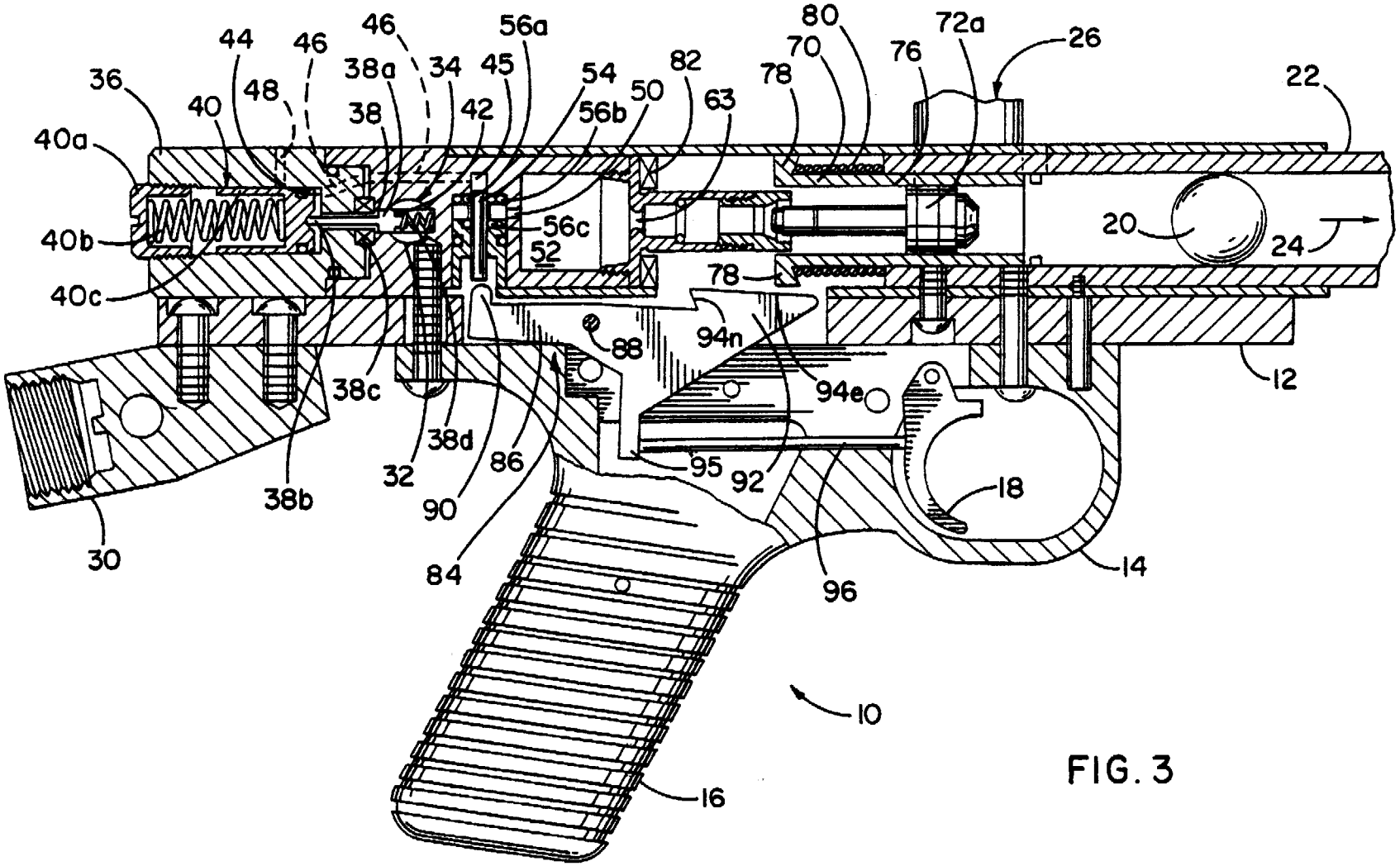
FIG. 3 is a sectional view of the compressed gas gun of FIG. 1 during a firing operation.

The present invention may be incorporated into a compressed gas gun 10 such as is shown in FIGS. 1–3. Many of the specific details are disclosed in U.S. Pat. No. 5,280,778, and will be more generally described here. The gun 10 includes a frame support 12 with a trigger-guard 14 and handle 16 extending therefrom. A pivotally mounted trigger 18 is disposed within the trigger-guard 14. As seen in FIGS. 2 and 3, a projectile 20 such as a marking pellet exits an elongated barrel 22 in the direction of arrow 24 during a firing operation. It is often desirable to prevent the exit velocity of projectile 20 from exceeding a maximum velocity, typically 300 feet per second. An ammunition feeding tube 26 supplies a plurality of projectiles which are fed to the gun, one at a time, as will be understood by those skilled in the art.

A $CO_2$ cartridge or canister 28 (FIG. 1) screws into a known type of tank adapter 30 threadably mounted to the frame support 12. The compressed gas or air contained in the cartridge 28 passes from the air cartridge adapter 30 via an enclosed inlet passageway 32 to a compressed gas delivery system including a pressure regulating assembly 34. The $CO_2$ canister 28 typically contains 12 grams of liquid carbon dioxide ($CO_2$) which is sufficient power for approximately 30 single shot rounds of the gun 10. The $CO_2$ contained in cartridge 28 is approximately 850 psi at room temperature and about 450 psi below zero degrees Fahrenheit. Accordingly, a varying range of pressure is supplied at inlet passageway 32 of the gun 10 during normal operating conditions at which the gun is utilized. Absent the arrangement of the present invention, this range of inlet pressure during operation tends to adversely impact on the consistency and accuracy of rounds fired.

As best seen in FIGS. 2 and 3, the pressure regulating assembly 34 is disposed in a cylindrical terminal housing section 36 of the gun. Compressed air supplied from the cartridge 28 is regulated with the use of a screw-type control and valve arrangement including a valve 38 and a regulating piston subassembly 40. The main structural details of the valve 38 include a head portion **38*a*, a valve stem 38*b*, a seat 38*c* and a biasing spring 38*d***. A longitudinal valve chamber 42 is formed in the housing section 36 in fluid communication with the inlet passageway 32. The valve head portion 38*a* is contained within the valve chamber 42 while the stem portion 38*b* extends to the regulating piston subassembly 40. The valve chamber 42 is also in communication with a longitudinal bore 44 containing the regulating piston subassembly 40. The compressed gas supplied to inlet passageway 32 and spring 38*d* coact to urge the valve head portion 38*a* in contacting relation with valve seat 38*c* when a desired pressure is attained.

The regulating piston subassembly 40 includes a threaded screw end 40*a*, a biasing spring 40*b* and a control piston 40*c*. This arrangement permits manual adjustment of the tension applied to the valve 34. In this way, control of the inlet pressure may be achieved.

The longitudinal bore 44 is in fluid communication with an on/off flow valve chamber 45 via fluid passageway 46. Likewise, an overflow passageway 48 permits compressed gas to exit from the longitudinal bore 44. A fluid passageway 50 permits regulated compressed gas to flow from the flow valve chamber 45 to a firing or air chamber 52.

When the pressure in the air chamber 52 falls below a predetermined pressure such as after a firing sequence, the regulating piston subassembly 40 urges the valve 38 to an open position. Compressed gas supplied to the air chamber 52 from the compressed source thereafter acts against the regulating spring tension to move the piston rearward. Thus, compressed gas is again discharged until the pressure in the air chamber 52 reaches the predetermined level sufficient to urge the valve 38 closed. In the preferred embodiment, the pressure regulating assembly 34 operates to adjust the pressure in the air chamber 52 to approximately 450 psi.

This arrangement ensures precise operation of the gun 10 for successive firings over a wide range of ambient temperatures. For example, when the ambient temperature increases, thereby increasing the gas pressure in the longitudinal bore 44, the spring 40*b* is urged rearward to close the valve 38. If the ambient temperature increases to a level where the pressure in the longitudinal bore 44 exceeds the desired air chamber pressure and the gas supply pressure, the valve 38 will move forwardly allowing gas in the longitudinal bore 44 to reenter the compressed gas supply. Conversely, when the ambient temperature decreases, thereby decreasing the pressure in the longitudinal bore 44, the gas supply pressure decreases, urging the valve 38 to an open position. In this way, the pressure regulating assembly 34 corrects for incremental pressure variations due to temperature changes, slight leakages and the like to insure that the compressed air supplied to the air chamber 52 is maintained at a desired pressure for each firing of the gun.

As seen in FIGS. 2 and 3, an on/off flow valve 54 permits fluid communication between the air chamber 52 and the pressure regulating assembly 34 in a ready-to-fire mode of operation, as shown in FIG. 2. In a fire mode of operation, the on/off flow valve 54 isolates the air chamber 52 from the pressure regulating assembly 34 and compressed gas source, as shown in FIG. 3. The on/off flow valve 54 is restrained from longitudinal movement by appropriate sealing means denoted by bushings 56*a–b*. The bushings 56*a–b* include bearing surfaces to facilitate transverse movement of the on/off flow valve 54 within a flow valve chamber 45. In addition, a pair of ring seal members 58*a–b* prevent the escape of compressed gas in the on/off flow valve 54.

Figure 4A:
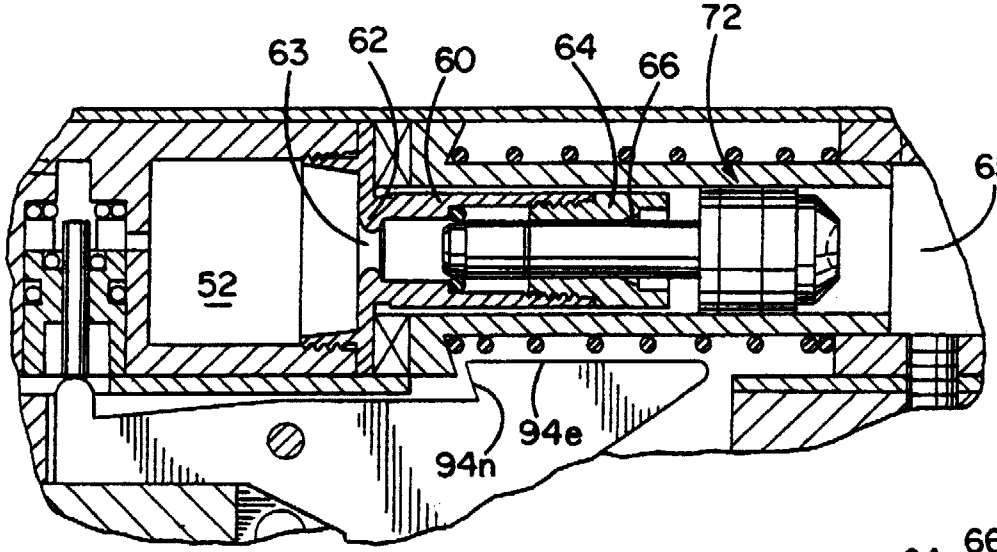
FIG. 4A and 4B are enlarged sectional views showing the control arrangement of the present invention in greater detail.
Figure 4B:
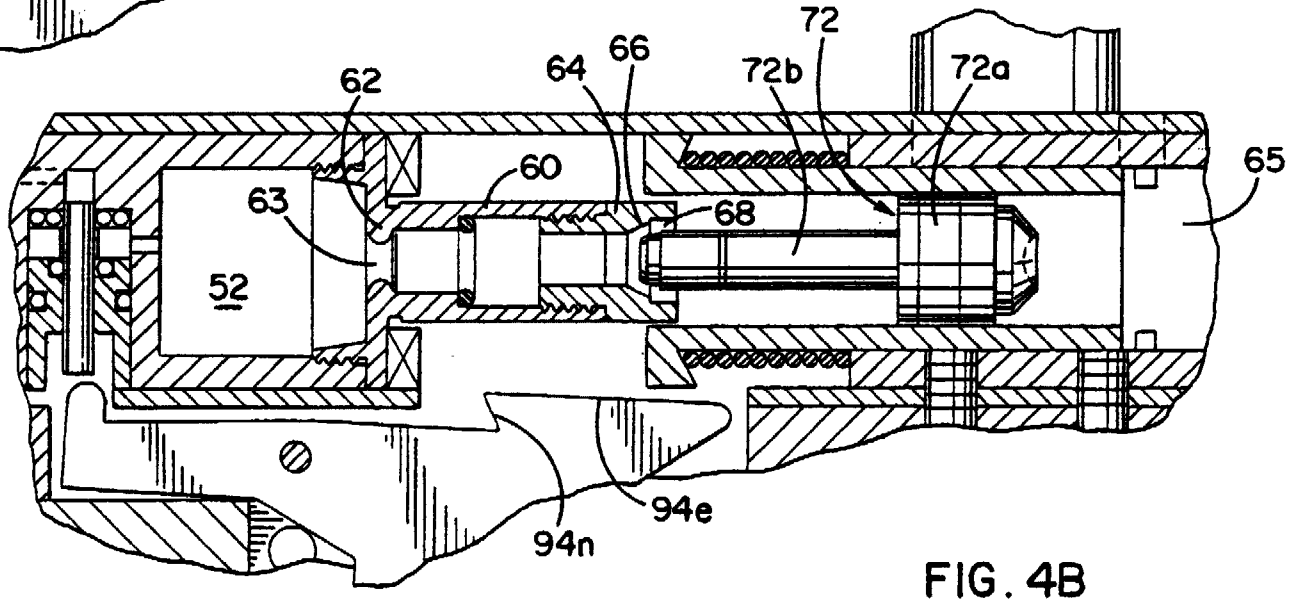

The firing or air chamber 52 according to the present invention is best seen in FIGS. 4A and 4B. The air chamber 52 is defined by a bore formed in the body portion of the gun 10 terminating at one end with an intermediate firing tube or power tube 60. The power tube 60 is adapted for threaded engagement within the bore. The power tube 60 includes, preferably at or in close relation to the exit point of the air chamber 52, a flange or lip section 62. The flange 62 protrudes inwardly to define a reduced diameter gas flow-through port or orifice 63 at or in close relation to the exit point of air chamber 52. In the preferred embodiment, the flange 62 provides a reduced diameter exit port in the range of 0.145 to 0.185 inches for an air chamber that contains 0.5 cubic inches of compressed gas at 350–600 psi. Under these operating conditions, the gun provides an exit velocity in the range of 250–300 feet per second for the projectile.

The control arrangement according to the present invention is so designed since the maximum flow velocity of a converging nozzle throat is Mach 1, the speed of sound. Any variation of pressure at the exit port beyond that required to produce sonic flow tends to produce sonic waves at the exit port. (See eg., Blevins, *Applied Fluid Dynamics Handbook* (Van Nostrand Reinhold Co., Inc. 1984), p. 127).

Thus, the air flow-through port 63 is designed so that the gas flow generated by firing the gun 10 is restricted to the speed of sound during normal operation. Similarly, the operating conditions of the gun can be controlled to meet tournament or other imposed regulations. It has also been found that the projectile velocity for the present invention is less sensitive to fluctuations of gas pressure in the air chamber 52. That is, where prior arrangements were designed with a substantially straight through-hole for an exit port and provided approximately 50 feet per second of projectile velocity variation for about 25 psi change in air chamber pressure, the present invention requires an air chamber pressure change on the order of 100 psi to achieve that same change in projectile velocity. Accordingly, variations in pressure have diminished impact on projectile velocity. This also allows for greater control as well as shot-to-shot consistency in the operation of the gun 10.

Figure 5:
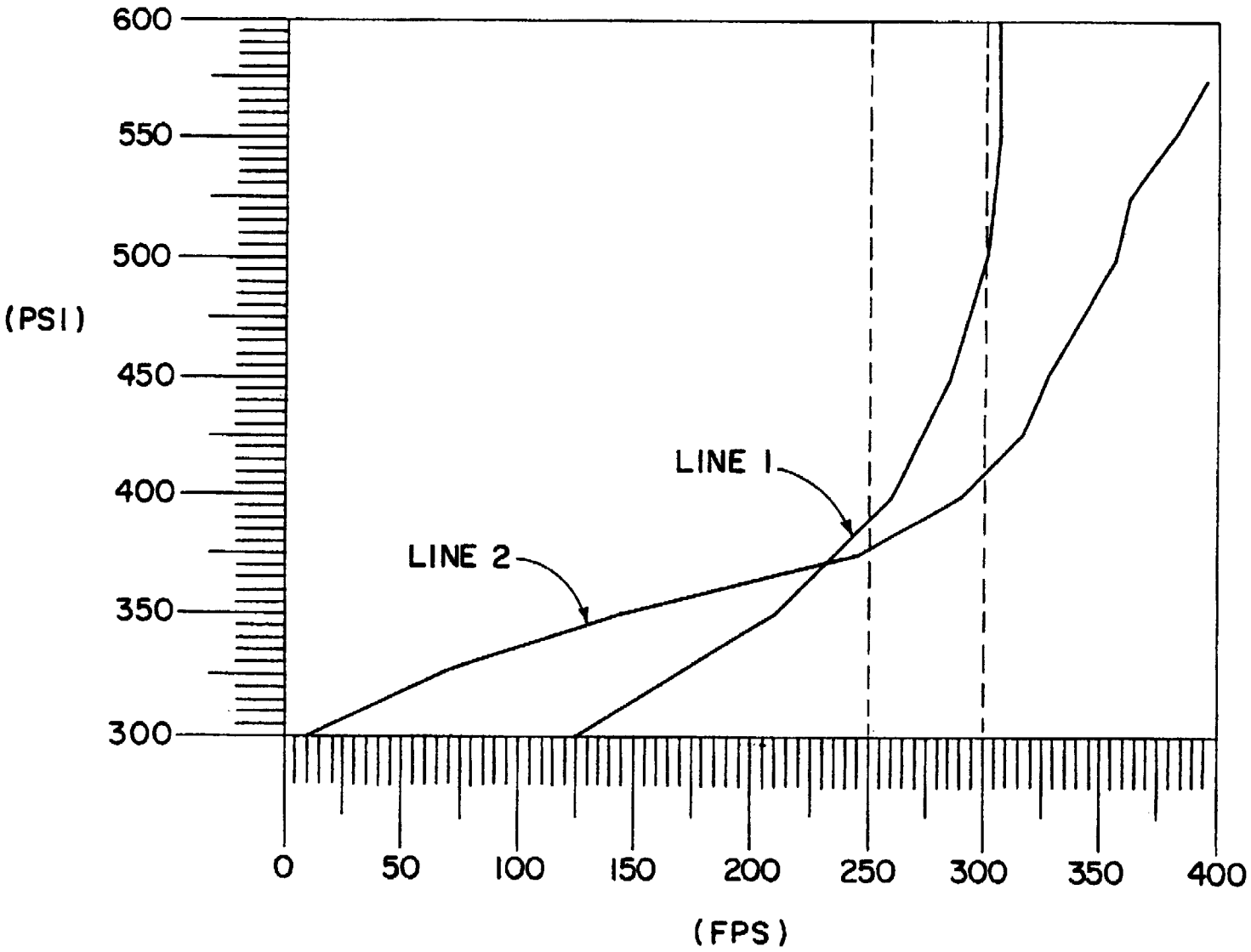
FIG. 5 is a graphical representation of air chamber pressure as a function of projectile velocity for the present invention in comparison with the prior art.

FIG. 5 is a graphical representation of air chamber pressure plotted as a function of projectile velocity illustrating the aforementioned improvement of the present invention. Line 1 of the graph in FIG. 5 is a plot of air chamber pressure (in psi) as a function of projectile velocity (in feet per second) for an arrangement utilizing an orifice diameter of approximately 0.152 inches and a flange radius of 0.046 inches. Such a reduced diameter exit port provides about 115 psi difference in air chamber pressure to achieve a projectile velocity change between 250 and 300 feet per second. On the other hand, line 2 is a plot of air chamber pressure (in psi) as a function of projectile velocity (in feet per second) for an arrangement utilizing a straight through-hole between the air chamber and power tube. This arrangement provides a far greater sensitivity to air chamber pressure, and particularly, about 30 psi difference in air chamber pressure to achieve the same change in projectile velocity.

An annular sleeve 64 interfits within the power tube 60 and, along with the power tube 60, defines a discharge path for compressed air contained in the air chamber 52 to blast into a breech 65 of the gun 10. The annular sleeve 64 includes a beveled portion 66 and an enlarged diameter end portion 68 that defines a passage for the blast of compressed gas. Inasmuch as pressure supplied to the air chamber 52 has been substantially reduced from the maximum available pressure generated by the $CO_2$ cartridge at room temperature, the volume defined by the air chamber 52 is substantially larger than found in many known arrangements.

The blast of compressed gas exits the air chamber 52 upon actuation of a bolt assembly 70, as shown in FIGS. 2 and 3, including a power piston 72, as shown in FIGS. 4A and 4B. The power piston 72 comprises head and body sections 72*a* and 72*b*, respectively, with the body section 72*b* being sized to fit within the annular sleeve 64 and power tube 60. FIGS. 2 and 3 illustrate the remaining structural features of the bolt assembly 70, including a cylindrical actuating bolt 76 disposed in surrounding relation to the annular sleeve 64 and power tube 60. The actuating bolt 76 includes a protruding dog portion 78 disposed at one of its ends. A recoil spring 80 retracts the actuating bolt 76 against a bumper 82 when the actuating bolt 76 is returned to a ready-to-fire position.

As described in detail in said U.S. Pat. No. 5,280,778, the bolt assembly 70 is maintained in a ready-to-fire position with the use of sear 84 having an arm 86 that is rotatable about pivot 88, a transversely extending actuating member 90 at one end, located on one side of pivot 88, and an interlocking element 92 at the other end, located on the other side of the pivot 88. The actuating member 90, or cam section, is generally aligned with the "on/off" valve 45. The interlocking element 92 includes a notched portion 94*n* that engages the dog portion 78 of the actuating bolt 76 in the ready-to-fire position. The interlocking element 92 preferably also includes an elongated portion 94*e* extending substantially along the path of travel of the actuating bolt assembly 70 to provide a stop surface to prevent the actuating bolt assembly from engagement with the interlocking element 92 during recoil of the actuating bolt assembly.

An actuating lever 95 projects transversely on the side of the latch arm 86 opposite the actuating member 90 and the interlocking element 92. A sliding trigger arm 96 disposed within the handle 16 operates to transmit force from the trigger 18 to the actuating lever 95. As explained in detail in said U.S. Pat. No. 5,280,778, this provides for semi-automatic firing of the gun 10 in operation.

The particular shape and location of the reduced diameter orifice 63 may be altered to change the operating characteristics of the gun 10. For example, the orifice 63 can be modified by at least the following: (1) alteration of the diameter of the orifice and (2) alteration of the orifice transition area, that is, the transition area between the air chamber 52 and the exit tube 60.

First, the diameter of the orifice 63 can be modified to alter the characteristics of the gun. Preferably, the diameter is designed in the range of 0.145 to 0.185 inches. As the diameter of the orifice is reduced, the maximum projectile velocity is restricted to a greater extent.

In addition, a reduction in the orifice diameter results in a reduced firing rate of the gun 10. In particular, the recoil spring 80 returns the actuating bolt assembly 70 to the ready to fire position only after substantially all of the gas contained in the air chamber 52 has been expelled. The smaller exit port diameter causes the duration in which the air chamber 52 transitions to ambient pressure to increase since the compressed gas contained within the air chamber 52 requires a longer time to bleed out through the exit port 63.

On the other hand, when the exit port diameter is chosen to be larger, the duration in which the air chamber 52 transitions to ambient pressure is reduced. Accordingly, the firing rate of the gun 10 is increased. Likewise, the projectile velocity is less restricted. Slight changes in the exit port diameter are particularly effective in altering the gas flow rate at supersonic or transonic levels.

Second, the orifice transition area can be modified to alter the characteristics of the gun 10. In the embodiment shown in FIGS. 4A and 4B, the curvature of the lip section 62 is substantially evenly contoured with a radius of 0.046 inches to provide an increased surface area between the air chamber 52 and exit tube 60. Such an increased orifice transition area tends to increase the exit velocity of the air blast, and has a similar effect as increasing the orifice diameter, particularly when the gas flow rate exiting the air chamber 52 is reduced to subsonic levels.

The contour of the lip section 62 may alternatively be constructed to provide a more abrupt transition at the exit location of the air chamber 52 by reducing the radius of curvature of the lip section closest to the exit point of the air chamber 52. The contour of the lip section may even be angled at the air chamber exit point. This arrangement provides more restriction on gas flow rate, particularly when the flow rate is reduced to subsonic levels.

The length of the lip section 62 may likewise be adjusted to achieve different gas flow characteristics. For example, the length of the lip section 62 may be increased to increase the surface contact area of the lip section 62. This adjustment tends to provide the same effect as reducing the diameter of the orifice, that is, a greater reduction in the gas flow rate and corresponding reduction in projectile velocity, particularly when the flow rate is at supersonic or transonic levels.

The location of the orifice 63 relative to the air chamber exit point may also be changed in order to change the characteristics of the gun 10. The orifice may be positioned either closely adjacent to the air chamber 52 or may be placed downstream from the air chamber 52 by modifying the air chamber to include a step therein.

Accordingly, a control arrangement for a compressed gas gun that meets the aforestated objectives has been described. It will be apparent to those skilled in the art that a number of modifications can be made to the invention disclosed, particularly by those having the benefit of the foregoing teachings, without departing from the spirit of these principles. Accordingly, it is intended that the invention be limited only by the scope of the appended claims.

What is claimed is:

1. A system for supplying a predetermined pressure of compressed gas in a compressed gas powered gun, the gun including a barrel for loading a projectile, and a firing mechanism operable in a first mode to actuate the gun and operable in a second mode to reload the gun, the system comprising:

a source providing compressed gas at a first outlet;

a pressure regulating assembly coupled with the first outlet disposed to receive compressed gas from the first outlet and to provide a predetermined pressure of compressed gas at a second outlet;

an air chamber coupled with an exit tube, the air chamber supplying a blast of compressed gas through the exit tube to expel the projectile through the barrel at a desired projectile velocity when the firing mechanism is in the first mode;

a flow valve disposed between the second outlet and the air chamber and coupled with the firing mechanism, the flow valve isolating the second outlet from the air chamber when the firing mechanism is in the first mode, the flow valve enabling fluid communication between the second outlet and the air chamber in the second mode; and a reduced diameter orifice disposed between the air chamber and the exit tube defining a curved transition area therebetween limiting the blast of compressed gas exiting from the air chamber and controlling the resulting projectile velocity.

2. The invention as in claim 1 wherein the reduced diameter orifice limits the maximum gas flow rate exiting from the air chamber to be less than the speed of sound during normal operation of the gun.

3. In a compressed gas gun having a source of compressed gas, barrel for loading a projectile, and a firing mechanism operable to actuate the gun, a metering arrangement comprising:

an air chamber supplying compressed gas to expel the projectile through the barrel when the gun is actuated;

an exit tube disposed between the air chamber and the projectile in fluid communication with the air chamber; and a control arrangement disposed between the air chamber and the exit tube, the control arrangement including a lip section that defines a reduced diameter orifice with a curved transition area proximate to the air chamber limiting the flow rate of compressed gas exiting from the air chamber and the resulting projectile velocity when the gun is actuated.

4. The invention as in claim 3 wherein the reduced diameter orifice limits the maximum gas flow rate exiting from the air chamber to be less than the speed of sound during normal operation of the gun.

5. A pressure regulating arrangement for use in a compressed gas gun having a source of compressed gas, barrel for loading a projectile, and a firing mechanism operable to actuate the gun, the pressure regulating arrangement comprising:

an air chamber supplying compressed gas to expel the projectile through the barrel at an exit velocity;

an exit tube disposed proximate the air chamber, the exit tube housing a piston which, upon actuation, is driven longitudinally within the exit tube to permit compressed gas to be expelled from the exit tube; and a tuned orifice interposed between the air chamber and the exit tube defining a curved tuned orifice transition area therebetween to restrict the amount of compressed gas expelled within the exit tube and to restrict the exit velocity of the projectile upon actuation of the compressed gas gun.

6. The invention as in claim 5 wherein the reduced diameter orifice limits the maximum gas flow rate exiting from the air chamber to be less than the speed of sound during normal operation of the gun.

* * * * *